US012742607B2

(12) United States Patent
Schmadeka

(10) Patent No.: US 12,742,607 B2
(45) Date of Patent: Sep. 22, 2026

(54) MUZZLE DEVICE WITH EXTERNAL THREADS AND ACCESSORY MOUNT

(71) Applicant: Kevin Schmadeka, Puyallup, WA (US)

(72) Inventor: Kevin Schmadeka, Puyallup, WA (US)

( * ) Notice: Subject to any disclaimer, the term of this patent is extended or adjusted under 35 U.S.C. 154(b) by 0 days.

(21) Appl. No.: 19/390,567

(22) Filed: Nov. 16, 2025

(65) Prior Publication Data

US 2026/0168754 A1 Jun. 18, 2026

Related U.S. Application Data

(60) Provisional application No. 63/833,551, filed on Dec. 16, 2024.

(51) Int. Cl.

| | |
|---|---|
| ***F41A 21/32*** | (2006.01) |
| *F41A 21/30* | (2006.01) |
| *F41A 21/34* | (2006.01) |
| *F41A 21/36* | (2006.01) |
| *F41C 27/18* | (2006.01) |

(52) U.S. Cl.

CPC ..... *F41A 21/325* (2013.01); *F41A 21/30* (2013.01); *F41A 21/34* (2013.01); *F41A 21/36* (2013.01); *F41C 27/18* (2013.01)

(58) Field of Classification Search

CPC ..... F41A 21/325; F41A 21/30; F41A 21/34; F41A 21/36; F41A 21/28; F41A 21/32; F41C 27/18; F41C 27/16

USPC ..... 89/14.2, 14.4, 14.3

See application file for complete search history.

(56) References Cited

U.S. PATENT DOCUMENTS

| | | | | |
|---|---|---|---|---|
| 1,055,416 | A * | 3/1913 | Pliones et al. | F41C 27/18 30/162 |
| 1,246,258 | A * | 11/1917 | Gerace | F41C 27/18 30/162 |
| 1,260,827 | A * | 3/1918 | Stefanov | F41C 27/18 30/162 |
| 1,314,672 | A * | 9/1919 | Kozlowski | F41C 27/18 30/162 |
| 1,532,960 | A * | 4/1925 | Tomanek | F41C 27/18 30/162 |
| D987,767 | S * | 5/2023 | Middleton | D22/118 |
| 2012/0079753 | A1* | 4/2012 | Evans-Hendrick | F41C 27/18 42/86 |

* cited by examiner

*Primary Examiner* — John Cooper
(74) *Attorney, Agent, or Firm* — Jonathan Kempf

(57) ABSTRACT

A muzzle device for a firearm is disclosed, comprising a hollow cylindrical body with a central bore extending along its longitudinal axis. A first end of the body engages the firearm muzzle via internal threads, while a second end engages a muzzle accessory via external threads. Coupled to the cylindrical body is a hollow accessory housing defining a cavity configured to receive an accessory or mating object. A retention mechanism, such as a resilient plate with an inclined insert or a spring-biased detent, secures the object within the cavity while allowing quick release. The housing may have various shapes and orientations relative to the cylindrical body to accommodate different accessories or aesthetic configurations. The device provides a durable, modular interface for attaching muzzle accessories and additional mounted components in a versatile assembly.

12 Claims, 9 Drawing Sheets

MUZZLE DEVICE WITH EXTERNAL THREADS AND ACCESSORY MOUNT

CROSS-REFERENCE TO RELATED APPLICATIONS

This application claims the benefit of, and priority to, provisional patent application 63/833,551, the entire specification of which is incorporated herein by reference in its entirety.

BACKGROUND

Field of the Art

The disclosure relates to the field of firearm attachments, and more particularly to the field of muzzle devices and mounted firearm accessories.

Discussion of the State of the Art

The US Military currently has no viable bayonet options for service rifles, except for during training with retired rifle models. This is due to the advent and adoption of full-length handguards that cover the part of the barrel where a bayonet lug would normally be placed, making old style bayonets unusable. Prior to this happening, bayonets could be used as a deterrent to threatening actions by approaching persons. Because of a lack of ability to attach bayonets or other deterrent devices, soldiers and National Guardsmen now face situations where unruly or dangerous people can walk up to close proximity, diminishing crowd control effectiveness and creating danger of attack for the serviceperson.

As well, bayonets are commonly mounted onto firearms with bayonet lugs. Muzzle attachments such as flash hiders, muzzle brakes, compensators, and suppressors are generally not interchangeably compatible with bayonet lugs due to the points of attachment on a firearm by a bayonet lug. Accordingly, there is an opportunity in the art for a mechanism to mount bayonets in a manner that is interchangeably compatible with muzzle attachments.

The present invention addresses this problem by creating a muzzle device with a single point mount for a bayonet or other deterrent device."

SUMMARY

The present invention discloses a muzzle device with external threads and accessory mount. The muzzle device attaches to the muzzle of a firearm using a threaded mechanism. Opposite of the muzzle attachment point is a muzzle attachment such as a flash hider, muzzle brake, compensator, or suppressor. Adjacent to the muzzle attachment are external threads allowing for the attachment of additional muzzle accessories.

Attached to the mount is a retention and securing mechanism with which to receive, retain, and secure a bayonet or other objects configured to fit within the retention mechanism. This invention allows for a means to mount bayonets and, more generally, various other objects in an interchangeably compatible manner on a firearm.

BRIEF DESCRIPTION OF THE DRAWING FIGURES

The accompanying drawings, which form a part of the present disclosure, illustrate exemplary embodiments of the invention. These drawings, together with the detailed description, serve to explain the principles of the invention without limiting its scope. All figures are schematic representations and are not drawn to scale.

DETAILED DESCRIPTION

The foregoing description of specific embodiments is intended to illustrate the broad principles of the invention and enable its implementation, not to limit its scope. Variations, substitutions, and modifications may be made by those skilled in the art without departing from the spirit and scope of the invention as defined by the appended claims. Features described in connection with one embodiment may be combined or interchanged with those of other embodiments where such combinations are technically feasible. The claims should therefore be interpreted to encompass all such modifications, equivalents, and alternatives consistent with this disclosure.

Disclosed is a muzzle device with external threads and attached accessory mount.

Figure 1:
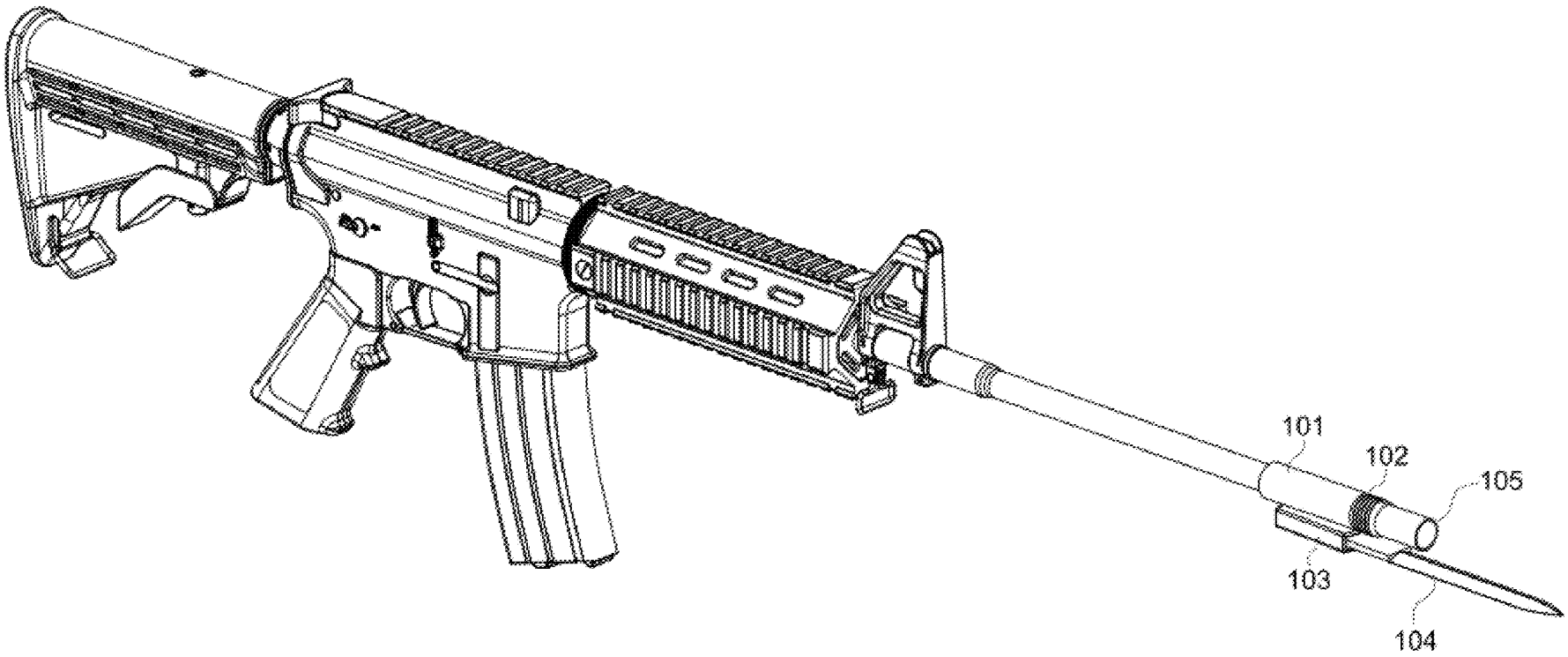
FIG. 1 illustrates a front perspective view of a muzzle device with external threads and accessory mount attached to a firearm.
Figure 5:
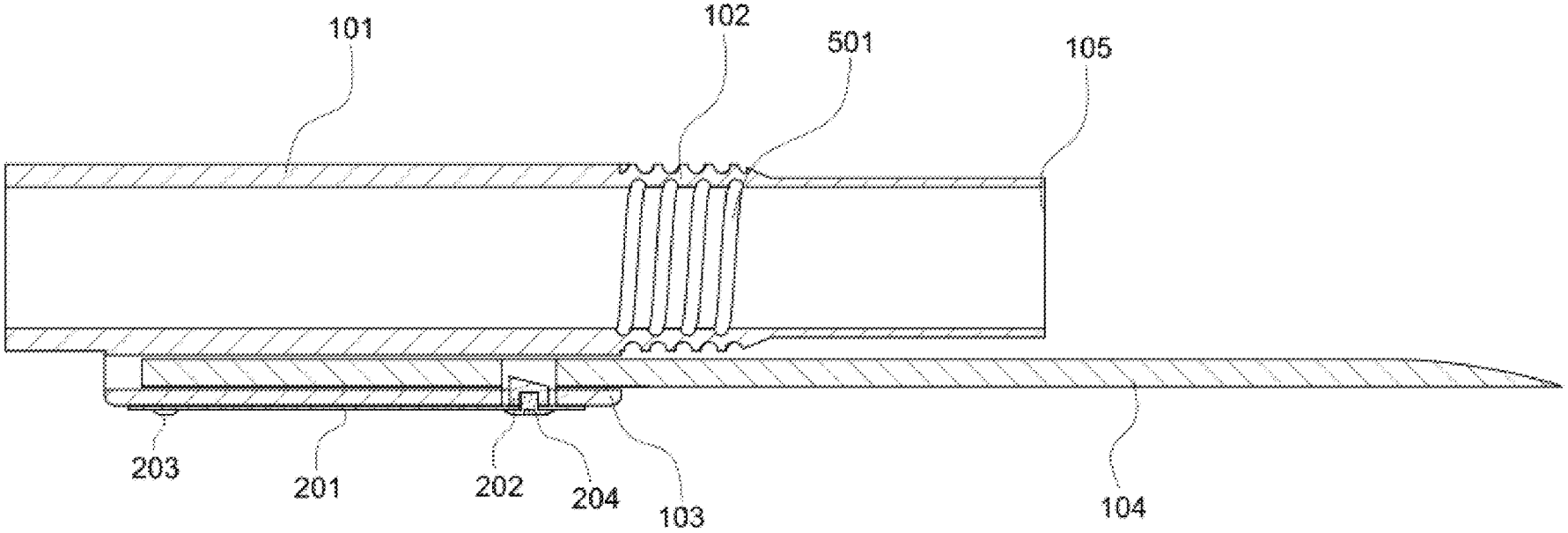
FIG. 5 illustrates a cross-sectional view of a muzzle device with external threads and accessory mount.

In one embodiment, illustrated in FIG. 1, the muzzle device comprises a hollow cylindrical body defining a central bore extending along its longitudinal axis. A first end of the cylindrical body is configured to slide over the muzzle and a portion of a firearm barrel (101). The opposite second end of the cylindrical body is configured receive a muzzle accessory—such as a flash hider, compressor, or compensator—in a sliding fit. Positioned axially inward from the second end of the cylindrical body are external threads (102), as illustrated in in FIG. 2, which are configured to engage the internal threads of a muzzle accessory (206) to secure the muzzle accessory to the muzzle device. Within the cylindrical body, shown in FIG. 5, are internal threads (302) designed to engage the external threads of a firearm muzzle, thereby affixing the invention to the firearm. These internal threads are located axially between the portion of the cylindrical body that slides over the firearm muzzle and the external threads positioned near the second end.

Figure 2:
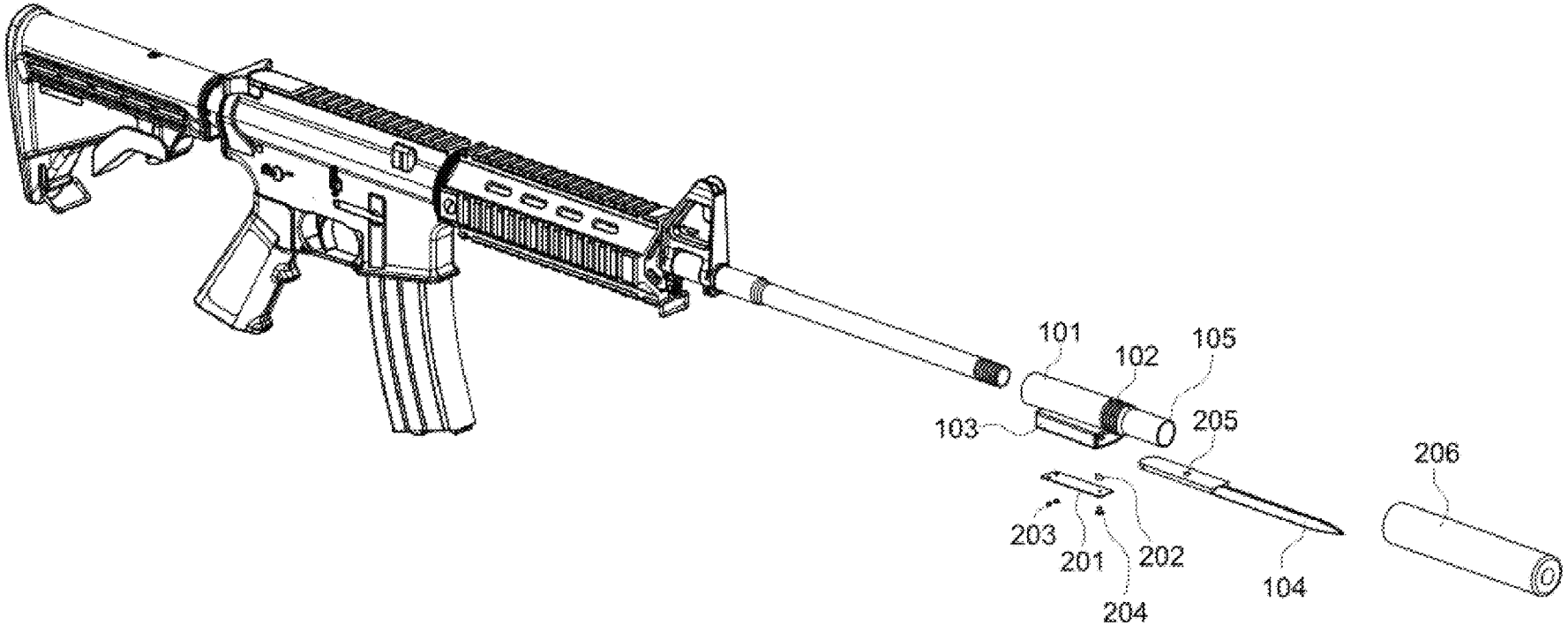
FIG. 2 illustrates a figure as in FIG. 1 with all individual parts separated from each other.
Figure 3:
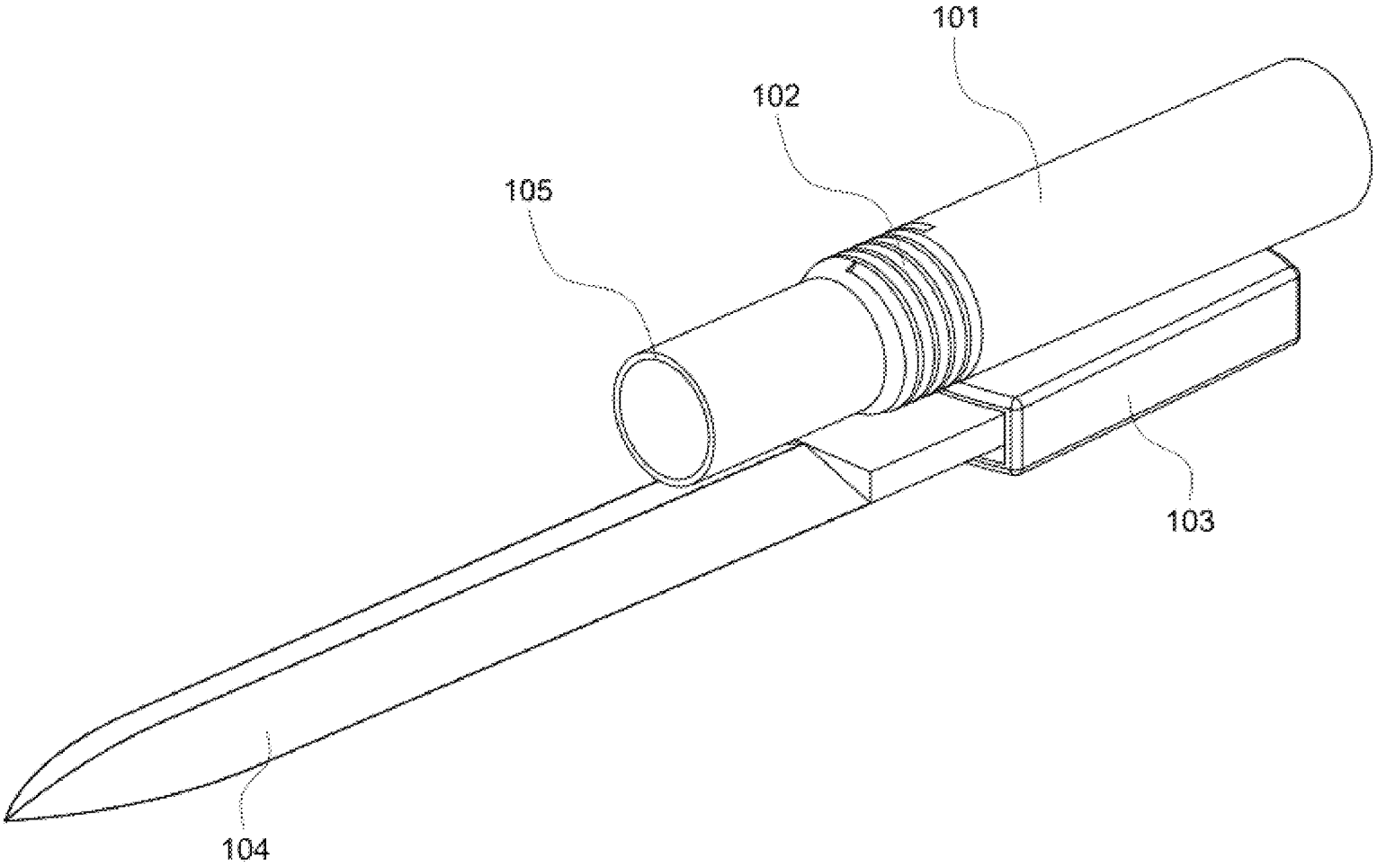
FIG. 3 illustrates a front perspective view of a muzzle device with external threads and accessory mount.

Shown in FIG. 2, an accessory mount is attached to the bottom portion of the muzzle device, wherein the "bottom"

is defined as the portion of the cylindrical body that faces downward when the firearm is held in a shooting position, oriented generally parallel to the ground. Shown in FIG. 8 and FIG. 9, the cylindrical body and accessory mount would have a plurality of welded beads (802) along the external surface along the longitudinal axis where both bodies meet on either side of the cylindrical body; the welded beads are excluded from other figures for clarity. The accessory mount comprises a hollow body (103) having a generally rectangular prism shape, with the body defining an internal cavity and comprising a plurality of planar surfaces forming an open-ended enclosure. The cylindrical body of the muzzle device is secured to the rectangular prism along the longitudinal axis of one external surface with the largest area as shown in FIG. 3; this surface of the rectangular prism is herein designated as the top surface of the rectangular prism. The rectangular prism also includes a left, right, bottom, and back surface, wherein the back surface faces the firearm. The front side of the rectangular prism is an open face, designed to receive an accessory or mating device. The bottom surface contains a generally circular aperture disposed proximal to the open face.

Figure 4:
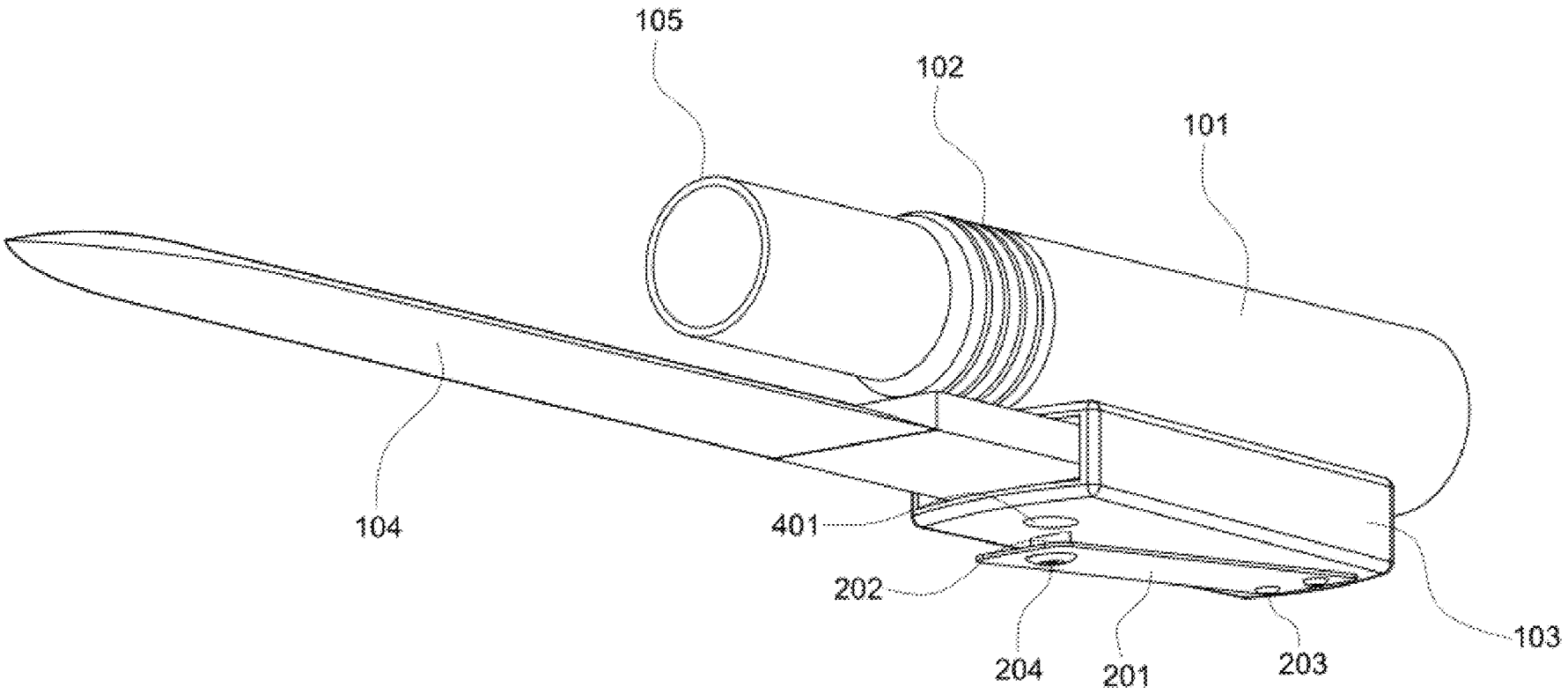
FIG. 4 illustrates a view of the underside of a muzzle device with external threads and accessory mount.

A resilient metal plate is affixed to the external bottom surface of the rectangular prism proximal to the back surface. A plurality of screws (203) disposed proximal to the back surface rectangular prism are used to affix the resilient metal plate to the bottom surface of the rectangular prism, shown in FIG. 4. Alternatively, the resilient metal plate may be affixed to the rectangular prism with fasteners such as rivets and interlocking features or merged together such as through welding or soldering. An inclined insert (202) is affixed to side of the resilient metal plate that faces the rectangular prism; a screw (204) inserted into the side of the resilient metal plate that faces away from the rectangular prism affixes the inclined insert. The inclined insert is disposed on the resilient metal plate such that it fits through the circular aperture of the bottom surface of the rectangular prism. The inclined insert is positioned such that the slope faces the open face of the rectangular prism as shown in FIG. 5.

Figure 6A:
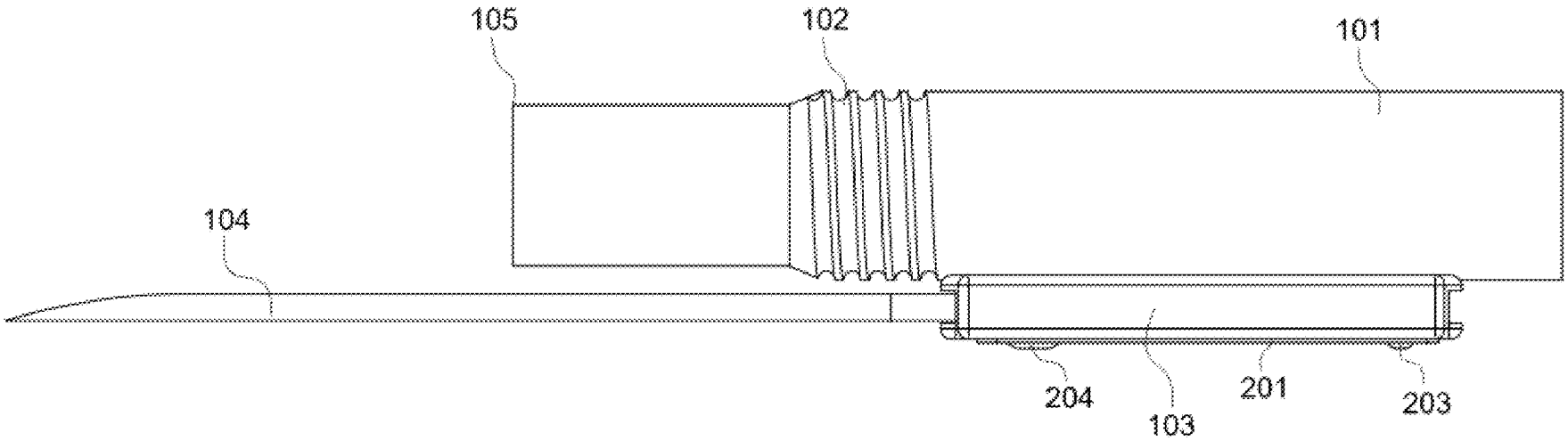
FIG. 6A illustrates a side view of a muzzle device with external threads and accessory mount wherein the accessory mount is engaged to an accessory.
Figure 6B:
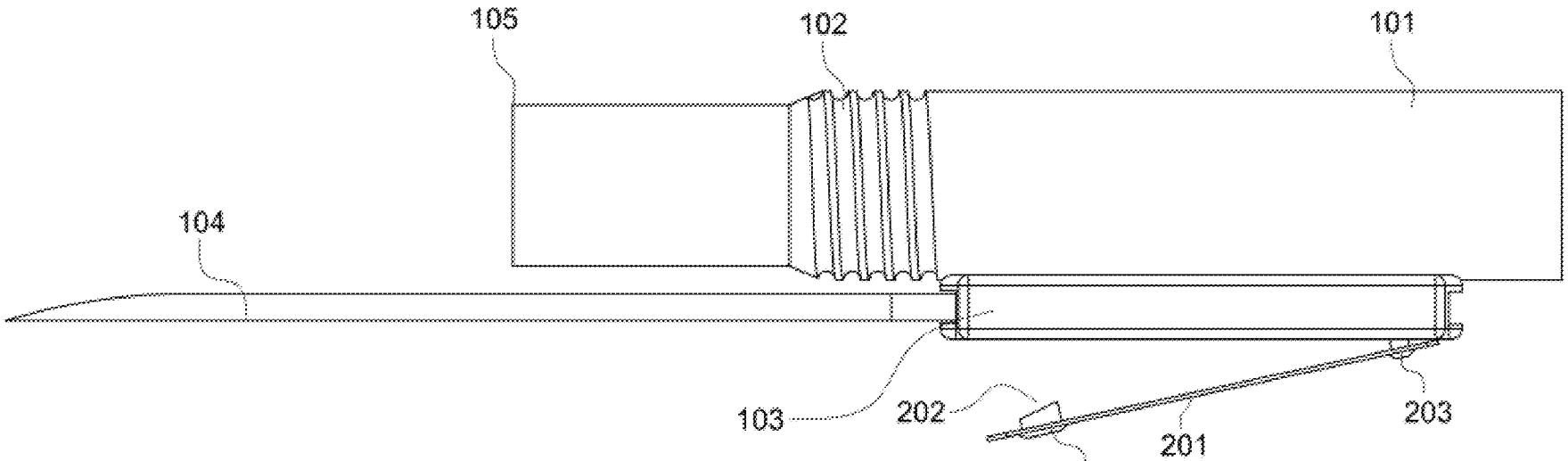
FIG. 6B illustrates a side view of a muzzle device with external threads and accessory mount wherein the accessory mount is disengaged from an accessory.

The rectangular prism will receive an object (104) shaped to slide and fit into the rectangular prism through its open front face. When slid into the open front face of the hollow rectangular prism, the object pushes the against the slope of the inclined insert, which pushes the resilient rectangular metal plate downwards and away from the external surface of the bottom of the rectangular prism. The object has a circular aperture designed to be secured by the inclined insert; once the object is fully received by the accessory mount, the object's aperture overlaps the circular aperture of the bottom face of the rectangular prism, causing the resilient rectangular metal plate to return to its original position and resulting in the inclined insert to extend through both apertures, securing the object in place, as shown in FIG. 6A and FIG. 6B.

In another embodiment, the generally circular aperture is disposed on the right or left surface of the rectangular prism instead of the bottom surface of the rectangular prism. The resilient metal plate is affixed to the external surface of the rectangular prism comprising the circular aperture proximal to the back surface. A plurality of screws disposed proximal to the back surface of the rectangular prism are used to affix the resilient rectangular metal plate to the surface of the rectangular prism comprising the circular aperture. An inclined insert is affixed to the side of the resilient metal plate that faces the rectangular prism and is disposed on the resilient metal plate such that it fits through the circular aperture. The inclined insert is positioned such that the slope faces the open face of the rectangular prism.

Figure 7:
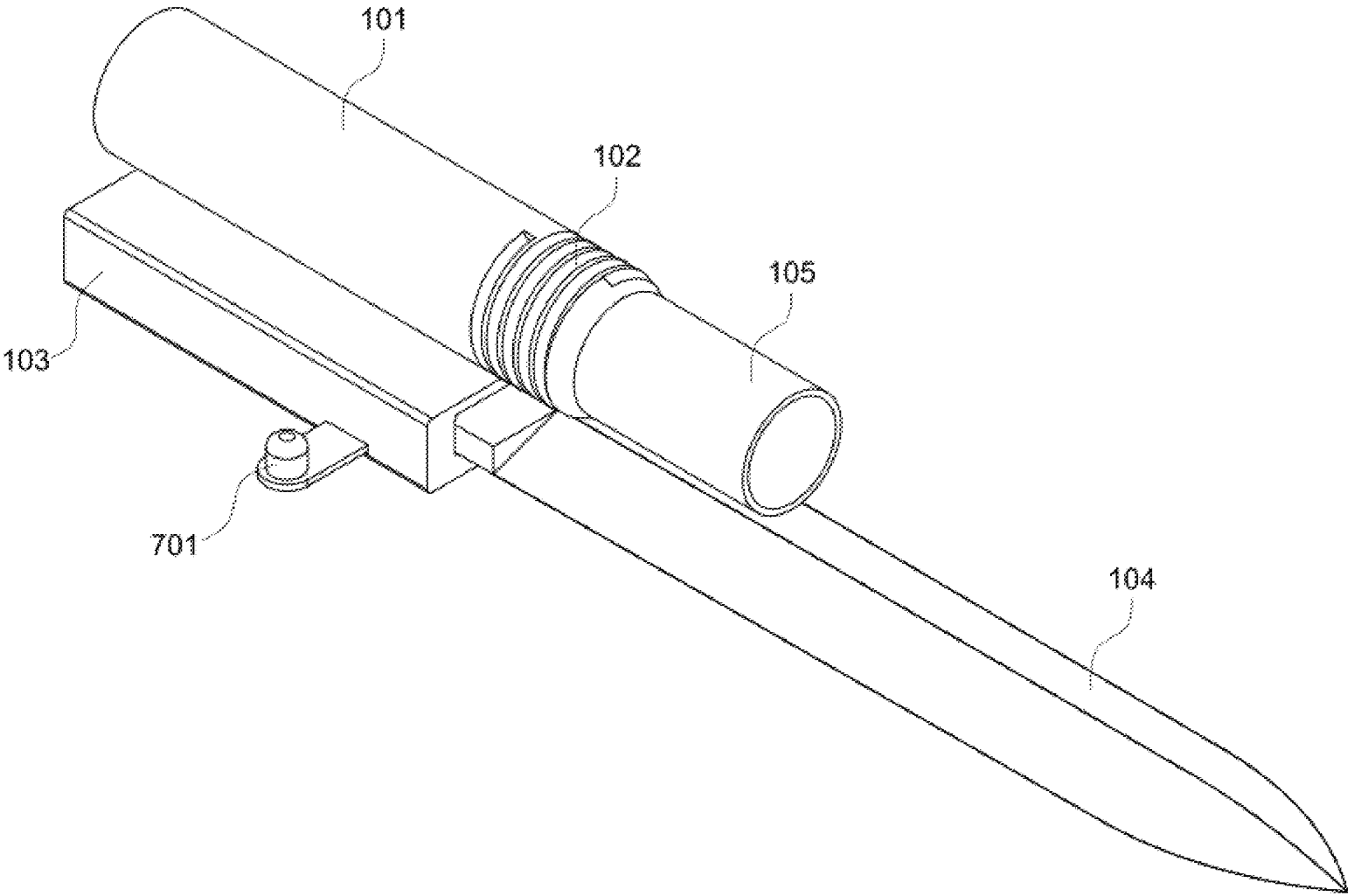
FIG. 7 illustrates an alternative embodiment of a muzzle device with external threads and accessory mount, wherein the accessory mount comprises an insert going through the accessory mount FIG. 8 Illustrates a cross-sectional view of the retention mechanism from FIG. 7.
Figure 8:
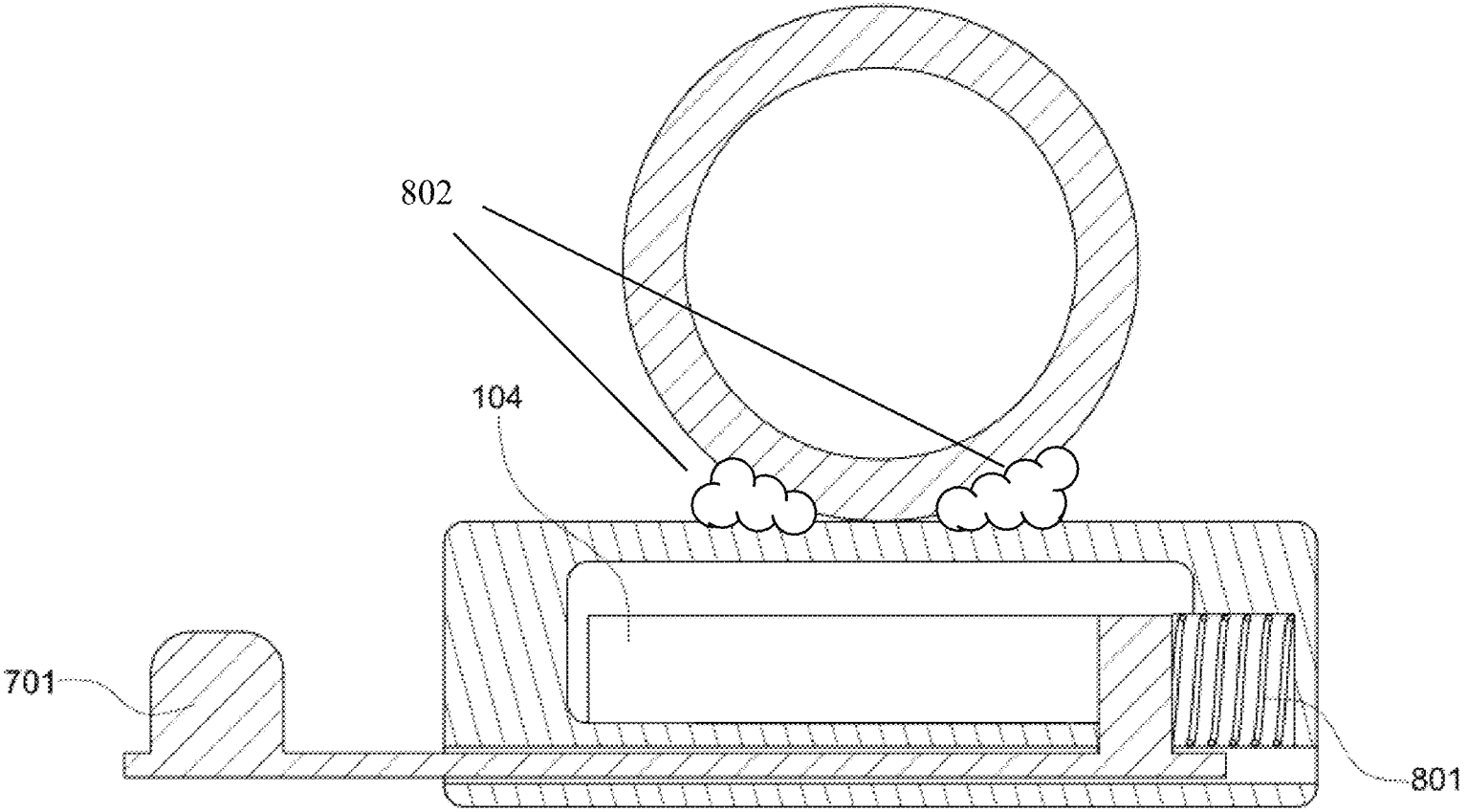
Figure 9:
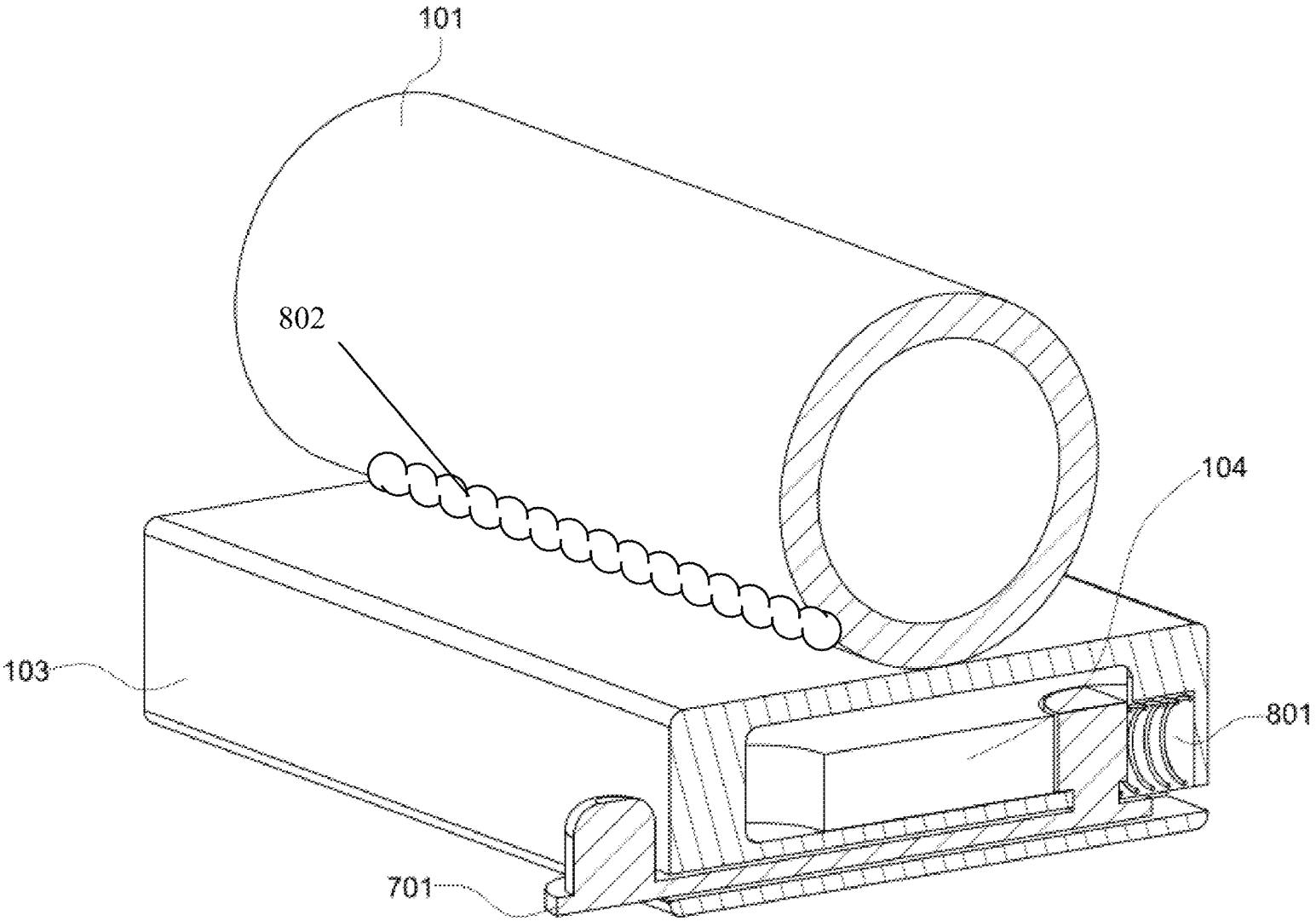
FIG. 9 Illustrates a perspective, cross-sectional view of FIG. 7, showing the engagement of the retention mechanism with an accessory.

In another embodiment, as shown in FIG. 7, the accessory mount comprises a hollow body having a generally rectangular prism shape, with the body defining an internal cavity and comprising a plurality of planar surfaces forming an open-ended enclosure. The rectangular prism also includes a left, right, bottom, and back surface, wherein the back surface faces the firearm. The front side of the rectangular prism is an open face, designed to receive an accessory or mating device. Disposed on the bottom face and proximal to the open front face is a through-opening extending through said bottom face from the left face to the right face. An insert designed to fit within the through opening (701) passes through it, as shown in FIG. 8. A first end of the insert extends beyond the dimensions of the rectangular prism. A second end of the insert, opposite the first end, comprises a raised portion. Within the face of the rectangular prism opposite the first end of the object lies a spring disposed to push against the raised portion on the second end of the insert. FIG. 9. illustrates how the mechanism works. When an object designed to fit into the rectangular prism through the front face, and with an indent configured to receive the raised portion of the insert, the spring will push the insert such that the raised portion will engage the indent to secure said object. Pushing the insert against the spring will disengage the raised portion, allowing the object to freely enter or exit the rectangular prism.

In another embodiment, a muzzle accessory may be permanently affixed to the end of the muzzle device originally designed to allow for a sliding fit of a muzzle accessory. This may be accomplished with fusion techniques such as welding or adhesive bonding. This may also be accomplished by integrally forming the muzzle device and muzzle accessory as a single, unitary component during the molding or casting process.

In another embodiment, the longitudinal axis of different parts of different faces of the accessory mount attaches to different portions of the muzzle device along its longitudinal axis. This allows for a wider range of orientations an accessory may be mounted relative to the firearm. In some instances, these varied orientations allow for a wide range of accessory types to be mounted onto a firearm.

In another embodiment, the accessory mount comprises a hollow portion with alternate geometries, including but not limited to cylindrical, trapezoidal, polygonal, or irregular shapes. The shape of the geometry may be selected based on aesthetic, ergonomic, or functional considerations. The hollow portion comprises an open portion used to receive and secure an object shaped to fit into said hollow portion.

The inventor has invented and reduced to practice a muzzle device that attaches to a firearm and includes a mechanism for securing an additional object. The device fundamentally comprises a hollow cylindrical body that defines a central bore running along its longitudinal axis. This cylindrical body features a first end specifically configured to engage and attach to the muzzle of a firearm. The device also includes a hollow housing coupled to the cylindrical body, which defines a cavity designed to receive an object dimensioned to fit within it. Crucially, a retention mechanism is coupled to this hollow housing and is configured to actively secure the received object within the cavity. This object is specifically contemplated as potentially being a bayonet.

In terms of further structural details, the cylindrical body may also include external threads positioned axially inward from its second end. These threads are designed to engage the internal threads of a muzzle accessory, allowing the attachment of accessories such as a flash hider, a muzzle brake, a compensator, or a suppressor to the muzzle device itself. Regarding the shape of the housing, the hollow housing is often described as having a generally rectangular prism shape and comprises an open face specifically designed to receive the object. However, the hollow portion of the housing is not limited to this shape and may comprise an alternate geometry, including cylindrical, trapezoidal, polygonal, or irregular shapes.

The retention mechanism can be implemented in several ways. One embodiment specifies that the retention mechanism includes a resilient metal plate affixed to an external surface of the hollow housing. More precisely, this resilient metal plate may be affixed to the external bottom surface of the rectangular prism housing, secured using a plurality of screws. Furthermore, an inclined insert may be affixed to this resilient metal plate, configured to extend through an aperture in the housing to ultimately secure the object.

Alternatively, the retention mechanism may comprise an insert that passes through a through-opening in the hollow housing. This insert may feature a raised portion on a second end, opposite a first end, with this raised portion being configured to engage an indent on the object being secured. To ensure a robust engagement, a spring may be disposed within the housing and configured to push against the raised portion of the insert, thereby forcing it to securely engage the indent on the object.

What is claimed is:

1. A muzzle device, comprising:

a hollow cylindrical body defining a central bore extending along its longitudinal axis;

the cylindrical body having a first end configured to engage and attach to a muzzle of a firearm;

the cylindrical body including external threads positioned axially inward from the second end and configured to engage internal threads of a muzzle accessory to secure a muzzle accessory to the muzzle device;

a hollow housing coupled to the cylindrical body, the hollow housing defining a cavity configured to receive an object dimensioned to fit within the cavity; and a retention mechanism coupled to the hollow housing and configured to secure the object within the cavity.

2. The muzzle device of claim 1, wherein the hollow housing has a generally rectangular prism shape and comprises an open face designed to receive the object.

3. The muzzle device of claim 1, wherein the retention mechanism includes a resilient metal plate affixed to an external surface of the hollow housing.

4. The muzzle device of claim 3, wherein the resilient metal plate is affixed to the external bottom surface of the rectangular prism.

5. The muzzle device of claim 4, wherein an inclined insert is affixed to the resilient metal plate and is configured to extend through an aperture in the housing to secure the object.

6. The muzzle device of claim 3, wherein the resilient metal plate is affixed to the housing using a plurality of screws.

7. The muzzle device of claim 1, wherein the retention mechanism comprises an insert that passes through a through-opening in the hollow housing.

8. The muzzle device of claim 7, wherein the insert comprises a raised portion on a second end, opposite a first end, the raised portion being configured to engage an indent on the object.

9. The muzzle device of claim 8, further comprising a spring disposed within the housing and configured to push against the raised portion of the insert to engage the indent on the object.

10. The muzzle device of claim 1, wherein the object is a bayonet.

11. The muzzle device of claim 1, wherein the muzzle accessory is selected from the group consisting of a flash hider, a muzzle brake, a compensator, and a suppressor.

12. The muzzle device of claim 1, wherein the hollow housing comprises a hollow portion with an alternate geometry selected from the group consisting of cylindrical, trapezoidal, polygonal, or irregular shapes.

* * * * *